United States Patent [19]

Rich et al.

[11] Patent Number: 4,551,127

[45] Date of Patent: Nov. 5, 1985

[54] TOY STRUCTURAL MEMBER ROLLER

[75] Inventors: Hubert A. Rich, Westminster; Gary M. Saffer, Torrance; William F. Sestito, Lakewood, all of Calif.

[73] Assignee: Mattel, Inc., Hawthorne, Calif.

[21] Appl. No.: 438,092

[22] Filed: Nov. 1, 1982

[51] Int. Cl.[4] ..... B31C 1/00

[52] U.S. Cl. ..... 493/462; 493/307; 493/959; 242/74.1

[58] Field of Search ..... 493/299, 307, 462, 466, 493/959, 303, 304; 242/74, 74.1

[56] References Cited

U.S. PATENT DOCUMENTS

| | | | |
|---|---|---|---|
| 1,436,643 | 11/1922 | Bolger | 493/299 |
| 1,570,248 | 9/1924 | Stelzer | 493/299 |
| 3,964,373 | 6/1976 | Christen, Jr. et al. | 493/307 |
| 4,039,299 | 8/1977 | Porter et al. | 493/307 |

*Primary Examiner*—Francis S. Husar
*Assistant Examiner*—William E. Terrell
*Attorney, Agent, or Firm*—Ronald M. Goldman; Melvin A. Klein

[57] ABSTRACT

A toy for rolling flexible material into structural members which may be assembled into any of a number of desired structures. The apparatus includes a base having bearing means formed on either end to support a tube assembly over which structural members are formed. One of the bearings is moveably mounted on the base and includes an enlarged opening to allow formed tubular structural members to be easily removed from the tube assembly. The tube assembly is comprised of inner and outer tubes rotatable with respect to each other and having elongated slots formed therein which are alignable in one position to allow flexible material to be inserted therein and gripped to facilitate the formation of a tubular structural member.

6 Claims, 20 Drawing Figures

PALLET ALEMAS
14
14
20
22
23
24
25
26
28
29
30
32
33
34
36
38
40
42
44
46
48
50
56
64
66
68
74
76
80

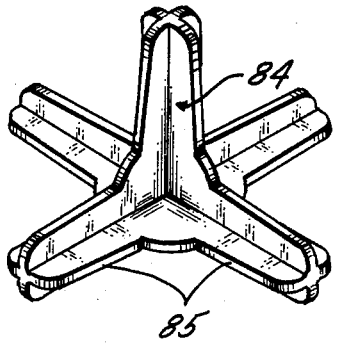
Fig. 15
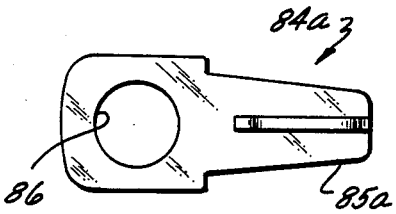
Fig. 15a
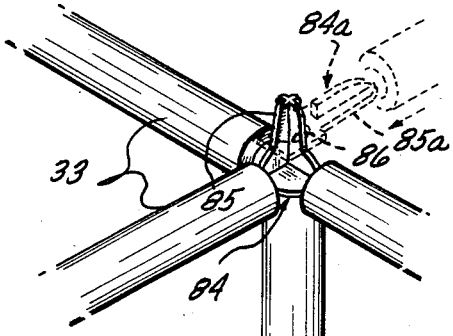
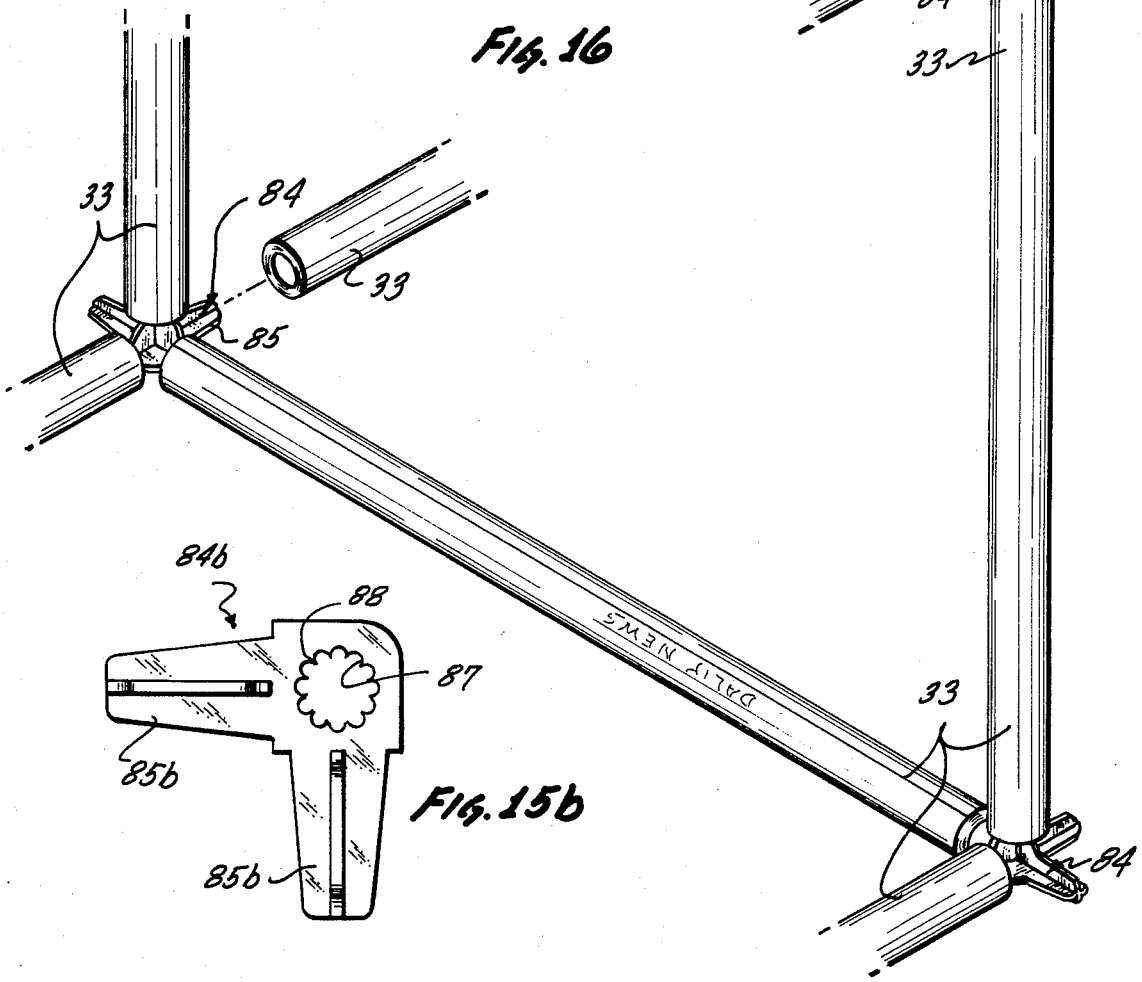
Fig. 16
Fig. 15b

TOY STRUCTURAL MEMBER ROLLER

BACKGROUND OF THE INVENTION

The present invention relates generally to activity toys and more particularly to a child's toy which allows the child to roll flexible sheet material into tubular structural members for use in assembling various shapes.

Prior art devices for rolling newspapers or other flexible material into logs for burning in a fireplace are known. Examples of such known paper log rollers are as follows: U.S. Pat. No. 3,936,007, issued Feb. 3, 1976. This patent discloses the use of a base on which there is mounted a spindle for rotation by a crank parallel to the base as well as movement perpendicular to the base. The perpendicular movement of the spindle is opposed by springs. U.S. Pat. No. 3,958,499, issued May 25, 1976, discloses a framework having a pair of vertical standards with bearing means at their upper ends. A crank arm extends through the bearing means and has an elongated shank portion. Newspapers draped over the shank portion of the crank are clamped in position and cranked to form a rolled section of newspapers. The rolled section may be tied in place and then a pin is removed from the end of the shank to allow the entire roll to be slipped off the shank. U.S. Pat. No. 3,964,373, issued June 22, 1976, discloses spaced apart end frames having an upwardly opening pan extending between and supported by the end frames. The pan is of semi-annular cross-section and contains leaf springs to apply force upwardly against material being wound on the shaft which is rotatably mounted between the end frames. In addition, the shaft may be withdrawn endwise from the end frames. U.S. Pat. No. 4,068,564, issued Jan. 17, 1978, discloses end plates and a central winding roller which is tapered and grooved and includes a crank arm at its larger end. The roller is removeably inserted between the end plates and includes further spring urged rollers floating in oblong slots in the end plates. The further rollers apply constant pressure to the central winding roller in three different directions against materials being rolled therein. Finally, U.S. Pat. No. 4,192,226, issued Mar. 11, 1980, discloses a deflectable table and an idler bar, both adapted for bearing against sheet material being rolled by means of turning a crank held in a frame.

None of the above discussed U.S. patents discloses apparatus having separate, slotted tubes for rolling flexible materials into elongated tubular structural members for use in completing various shapes.

SUMMARY OF THE INVENTION

The present invention relates to apparatus for rolling newspaper or other flexible materials into elongated, tubular structural members. The apparatus includes a slotted tube having inner and outer members working together to lock and unlock the leading edge of a newspaper inserted therebetween. The tube assembly is mounted on bearing means with one of the bearing means being pivotedly mounted so as to align an enlarged opening formed therein with a structural tubular member that has been rolled on the tube assembly. A pusher slidedly held on the tube assembly is used to push rolled structural members from the tube assembly through the enlarged opening in the pivotable bearing.

BRIEF DESCRIPTION OF THE DRAWINGS

Reference is now made to the accompanying drawings wherein:

FIGS. 15, 15*a*, and 15*b* show various connectors for joining completed tubular members together to build various shapes; and FIG. 16 shows a plurality of tubular structural members held together by the connectors of FIG. 15.

DESCRIPTION OF THE PREFERRED EMBODIMENTS

Figure 1:
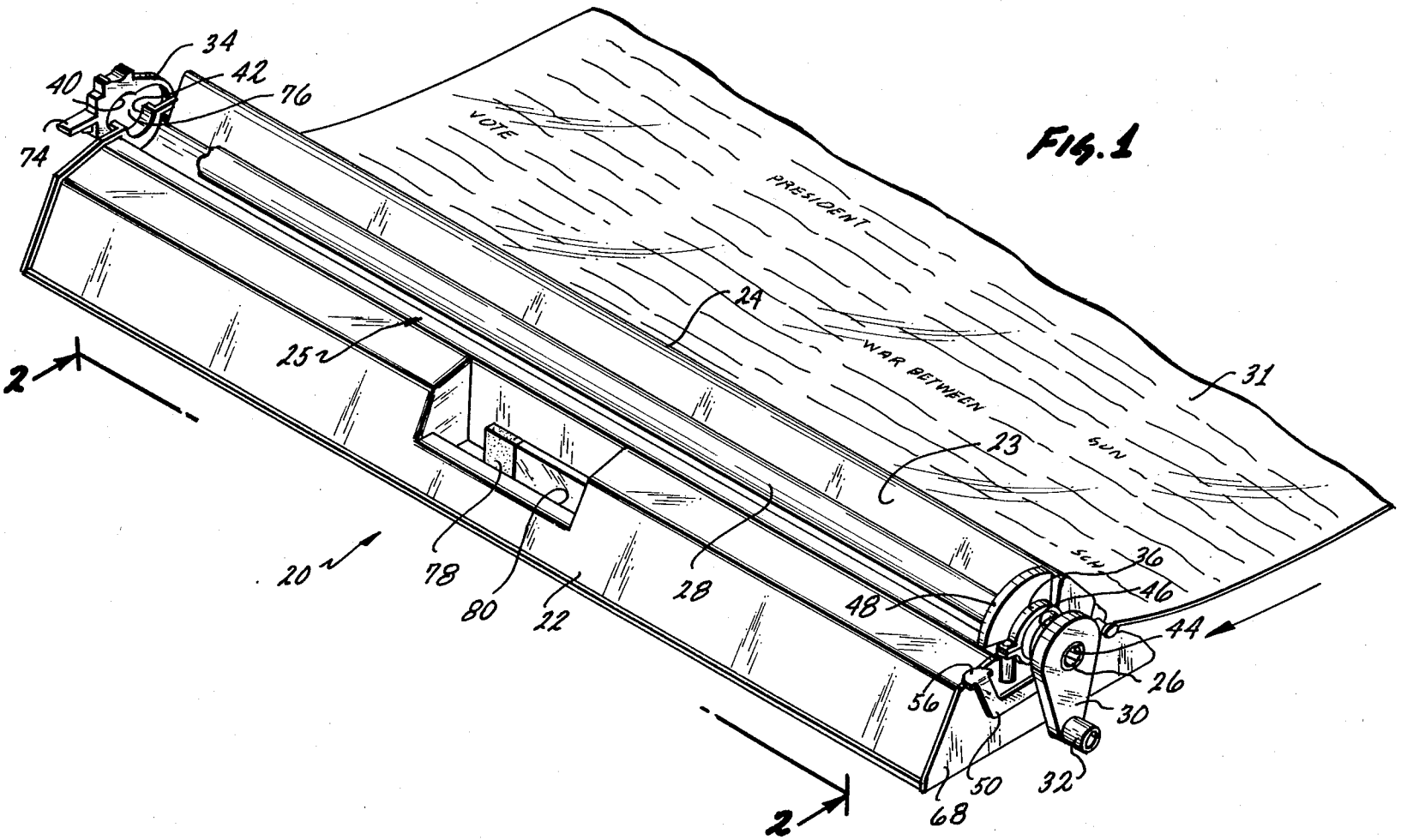
FIG. 1 is a perspective view of the structural rolling apparatus of the present invention, showing part of the tube assembly broken away.
Figure 2:
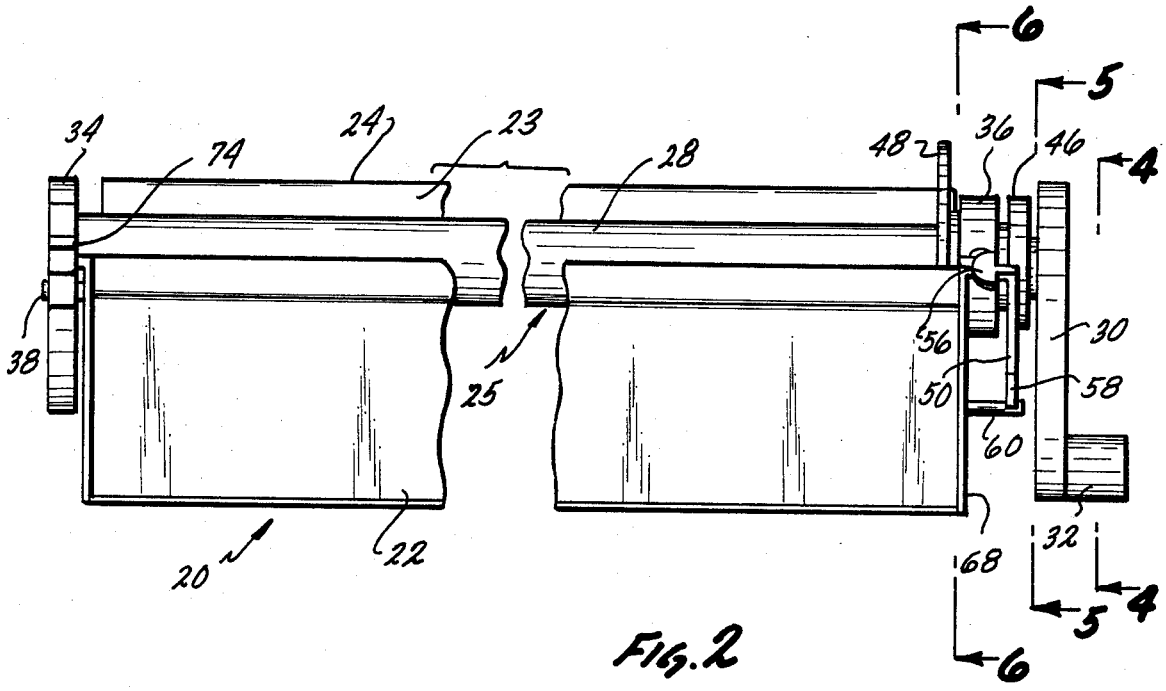
FIG. 2 is a partial front view looking in the direction of the arrows 2—2 in FIG. 1.
Figure 3:
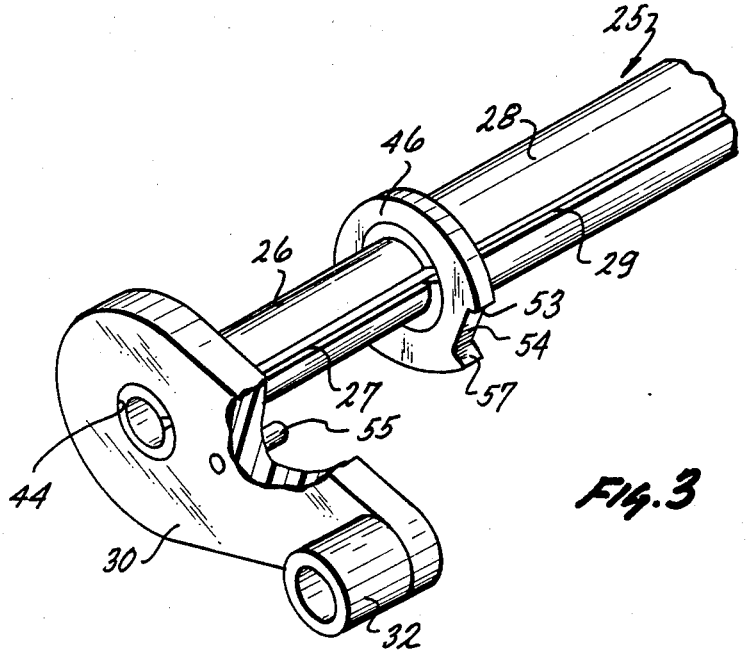
FIG. 3 is an enlarged perspective view showing the crank, ratchet element, and a portion of the tube elements, with a part of the crank broken away.
Figure 3A:
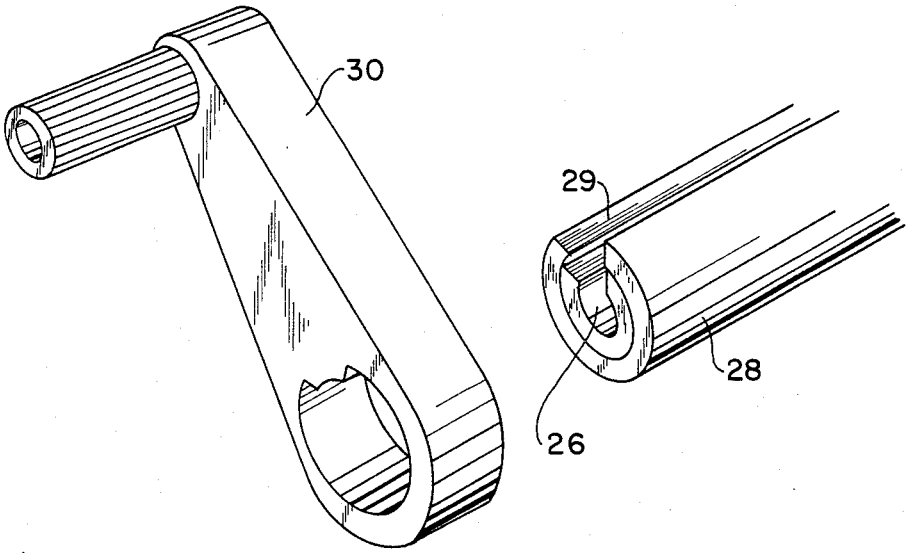
FIG. 3*a* is an exploded isometric view of a different embodiment in which the crank is connected to the outer tube.
Figure 4:
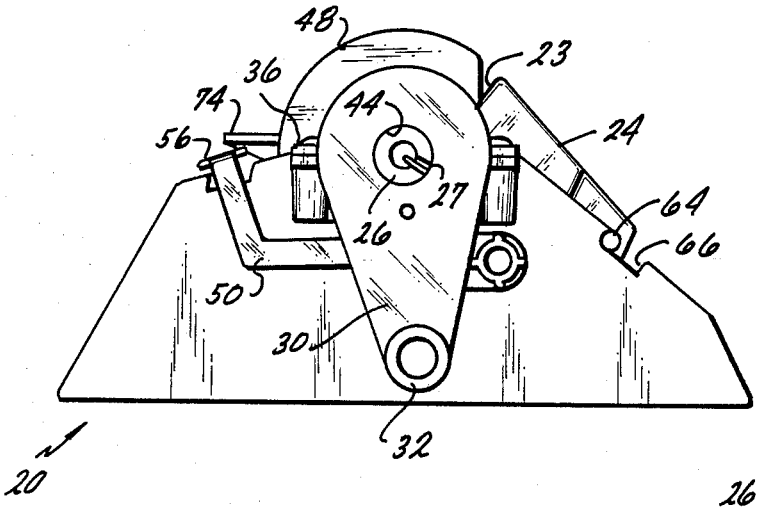
FIG. 4 is a side view looking in direction of the arrows 4—4 of FIG. 2.
Figures 11, 12:
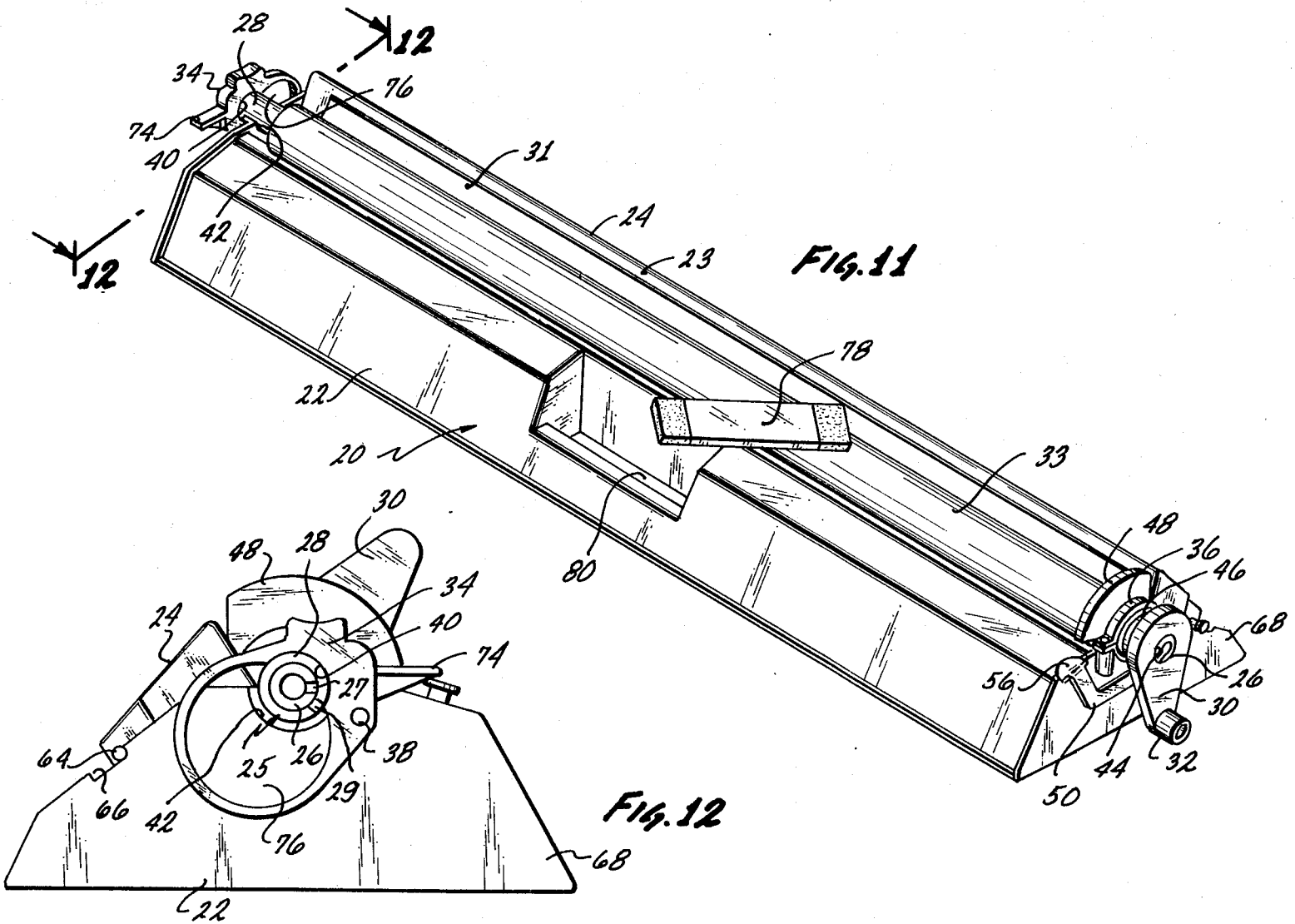
FIG. 11 shows a further perspective view of the apparatus with a tubular structural member rolled thereon and a glue stick applying glue to the loose end of the flexible material to seal the structural member.
FIG. 12 is an end view looking in the direction of the arrows 12—12 of FIG. 11, showing the pivotal bearing member.

Turning now to the drawings wherein like reference numerals throughout the several views refer to like elements, there shown is a rolling apparatus 20 having a base 22, a tension bar 24, a tube assembly 25 with inner and outer hollow tubes 26, 28, having elongated slots 27, 29 formed therein and a crank 30 with a handle 32. The base includes two bearings 34, 36 for rotatably supporting the tube assembly. As shown most clearly in FIGS. 2, 12, and 14, bearing 34 may be pivotably or slidably mounted on the base, as at point 38. Bearing 34 includes a semi-circular opening 40 which, when the bearing 34 is in the closed position as shown in FIG. 1 coacts with a further semi-circular portion 42 formed on the base 22 to provide a circular bearing surface in which one end of the outer tube 28 is removably held.

Bearing 36 may be fixed and formed in two pieces or integrally with the base 22. This fixed bearing is of such a size as to allow the tube assembly 25 to be passed therethrough and to rotatably hold the outer tube 28 therein. The crank 30 is provided with a hole 44 in which one end of either of the hollow tubes, preferably the hollow inner tube 26, assembled inside of the hollow outer tube 28, is fixedly connected so as to turn with rotation of the crank. Either of the inner or outer tubes, as by reversing the parts, but preferably the outer tube 28 is rigidly connected to a ratchet 46 mounted between the bearing 36 and the crank 30. A pusher element 48 is slidably mounted on the outer tube between the bearings 34, 36. This pusher element is used to remove any formed tubular structures, as is explained more fully hereinafter.

Figure 5:
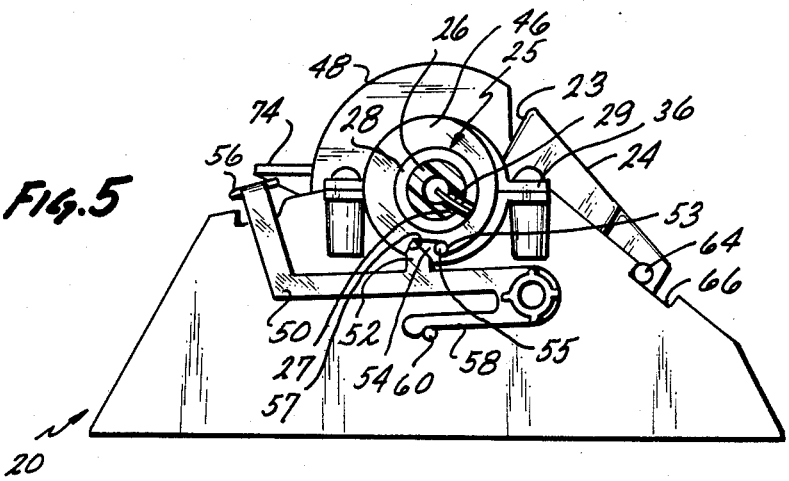
FIG. 5 is a sectional view taken along the line 5—5 in FIG. 2.
Figure 6:
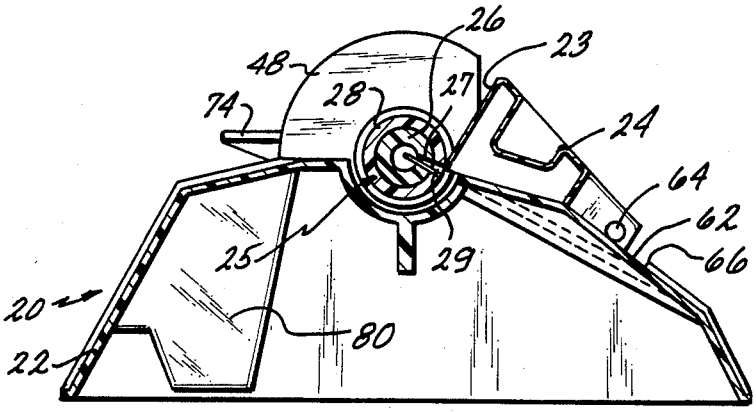
FIG. 6 is a sectional view taken along the line 6—6 in FIG. 2.
Figure 7:
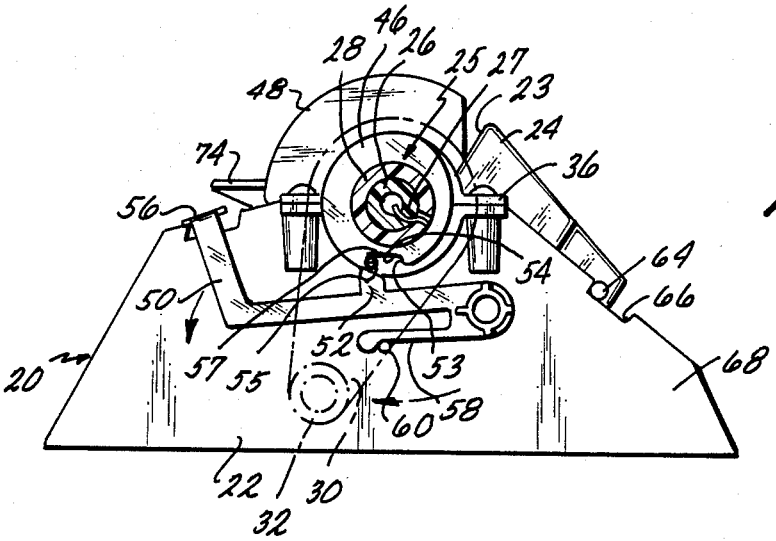
FIG. 7 is the same view as FIG. 5, with the crank rotated in the counter-clockwise direction, to lock a newspaper between the tubes of the tube assembly.
Figure 8:
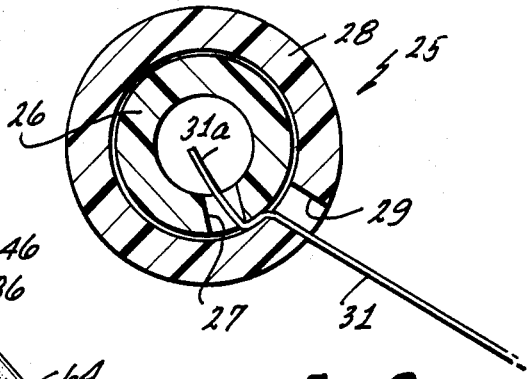
FIG. 8 is an enlarged sectional view showing a section of newspaper locked between the inner and outer tubes.
Figure 9:
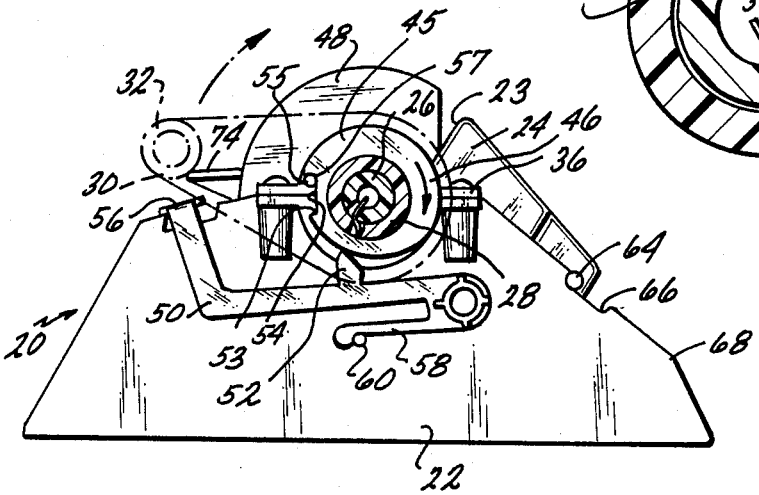
FIG. 9 is a view similar to that shown in FIGS. 5 and 7 with the crank rotating in the clockwise direction.

A ratchet spring 50 is mounted to the base 22 adjacent the crank 30. As shown more clearly in FIGS. 5, 7, and 9, the ratchet spring includes a stop 52 normally biased into a slot 54 formed in the ratchet 46 to limit counter-clockwise rotation of the crank and ratchet. A pin 55 formed integrally with the crank also moves within the slot 54 of ratchet 46 to allow the inner tube 26 attached to the crank to be rotated a pre-selected distance until the pin abuts against one end wall 53 of the slot. This distance may vary, but could be up to approximately 20 degrees, to thereby allow the inner tube 26 to rotate with respect to the outer tube 28, the same distance. This is most clearly shown in FIG. 8, where the inner tube 26 is shown rotated with respect to the outer tube 28 to thereby lock the forward or leading end 31*a* of a piece of newspaper 31 between the rotated tubes.

Figure 8A:
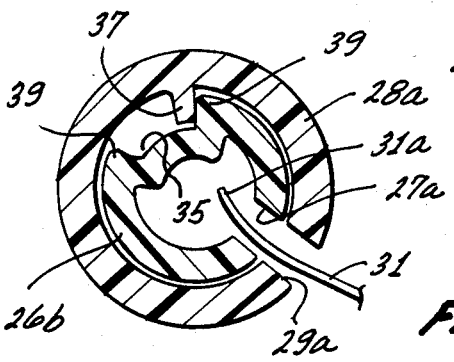
FIG. 8*a* is an enlarged sectional view showing modified inner and outer tubes to lock the leading edge of a newspaper therebetween.
Figure 10:
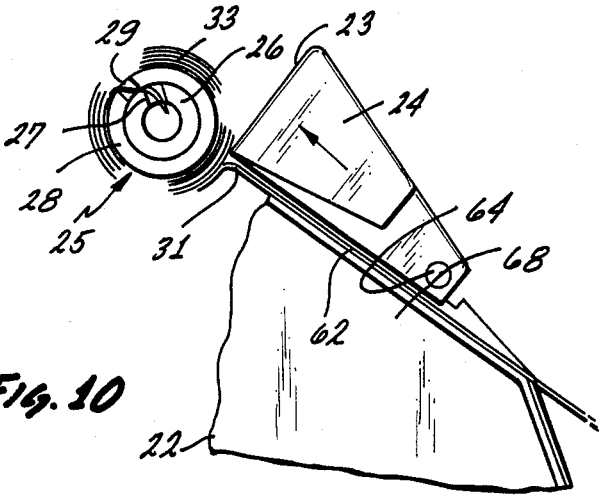
FIG. 10 is a partial sectional view showing the tension bar of the invention pressed against the newspaper being rolled on the tube assembly.

A further modification of the tube assembly is shown in FIG. 8*a*. In this modification, the inner tube 26*a* is formed or molded so as to have an indented or cutout portion 35 which coacts with an integral stop 37 formed internally of the outer tube 28*a*. This tube assembly works substantially the same as the tube assembly shown in FIG. 8. However, no stop pin 55 is needed since the pin 37 will prevent rotation of the inner tube 26*a* whenever either of the ends 39 of the cutout 35 contact the same.

Should it be desired to release the ratchet 46 for any reason to allow the crank to be turned further in the counter-clockwise direction, the user may push a button 56 formed integrally with the ratchet spring 50. Pushing downwardly on button 56, as shown by the direction of the arrow in FIG. 7, causes downward movement of the rachet spring to thereby release the stop 52 from within the slot 54 of the ratchet. This releases the rachet and allows the crank 30 to be continuously turned in the counter-clockwise direction. A biasing or spring element 58 is preferrably formed intergrally with the ratchet spring 50 and coacts with a pin or the like 60 extending from the base 22 to bias the stop 52 of the ratchet spring into position within slot 54.

To hold newspapers 31 in position as they are being rolled, tension bar 24 rests on a slanted ramp 62 of base 22 over which the paper is passed. As shown most clearly in FIGS. 4–7, 9, 10, 12, and 14, the tension bar may contain pins 64 extending from both sides thereof. The pins 64 may seat within elongated slots 66 formed within elevated walls 68 at the sides of the base 22. Springs or other biasing means held either internally or externally of the base may be used to bias the tension bar down against the base.

Rotatable bearing 34 includes a handle or other means 74 which may be pulled or pushed to move or rotate the bearing to a position whereby a tubular structural member formed on the tube assembly may be pushed off through an enlarged opening 76 formed within the bearing.

OPERATION OF THE INVENTION

A preferred embodiment the invention, such as that shown in the drawings to form a structural member from newspapers or other flexible material 31 will now be described, the handle 32 is grasped to rotate the crank 30 in one direction, preferably counter-clockwise, until any play of stop 52, acting within slot 54 of ratchet 36, prevents further rotation of the ratchet. At the same time, since the crank is connected to either the inner tube 26 or 26*a* and the pin 55 moves within the slot 54 until it is stopped against end wall 53 of the slot, or the cutout 35 rotates until an end 39 contacts the internal stop 37, the inner tube will also rotate with respect to the outer tube 28 or 28*a*. In this position, the elongated slots 27, 29, 27*a*, 29*a* formed respectively in the inner and outer tubes are aligned. This also locates the slots in the correct position with respect to the ramp 62 of base 22. A piece of newspaper or other flexible material 31 is then placed on slanted ramp 62, pushed under tension bar 24 and the leading or starting end 31*a* inserted into the hollow tubes 26, 26*a*, 28, 28*a* through the elongated slots. The crank and handle are then rotated in the opposite direction, preferably clockwise. This clockwise rotation first rotates the inner tube 26, 26*a*, inside of the outer tube 28, 28*a* until either pin 55 comes to rest against the other end wall 57 of slot 54 or the other end 39 contacts the internal stop 37. In this position, the end of the paper is firmly gripped between the tubes (See FIGS. 7 through 10 and, in particular FIGS. 8 and 8*a*). Further rotation of the crank and handle in the same direction, i.e., clockwise, turns the entire tube assembly and rolls the paper around the outer tube 28 or 28*a*. As the paper is being rolled, the tension bar 24 presses against the outer surface of the paper (See FIG. 10). When the paper is completely rolled on the tube assembly, the crank is continuously turned until the end flap of the paper lays against the verticle face 23 of the tension bar. Glue, which may be in the form of a stick 78 held within a storage compartment 80 formed in the base 22 may then be applied to the paper flap. The crank is then rotated clockwise several more revolutions to allow the tension bar to press the glued flap and complete the structural member.

To remove the tubular structural member from the rolling apparatus of the present invention, the crank handle is rotated counter-clockwise until the crank stops, as described hereinabove. The rotation of the crank handle does two things; first and inner tube 26 or 26*a* is rotated with respect to the outer tube 28 or 28*a* until the slots in the tubes line up. The alignment of the slots frees the starting end 31*a* of the paper used to make the formed structural member. Secondly, the counter-clockwise rotation of the tube assembly also loosens the structural member on the tube assembly.

Figures 13, 14:
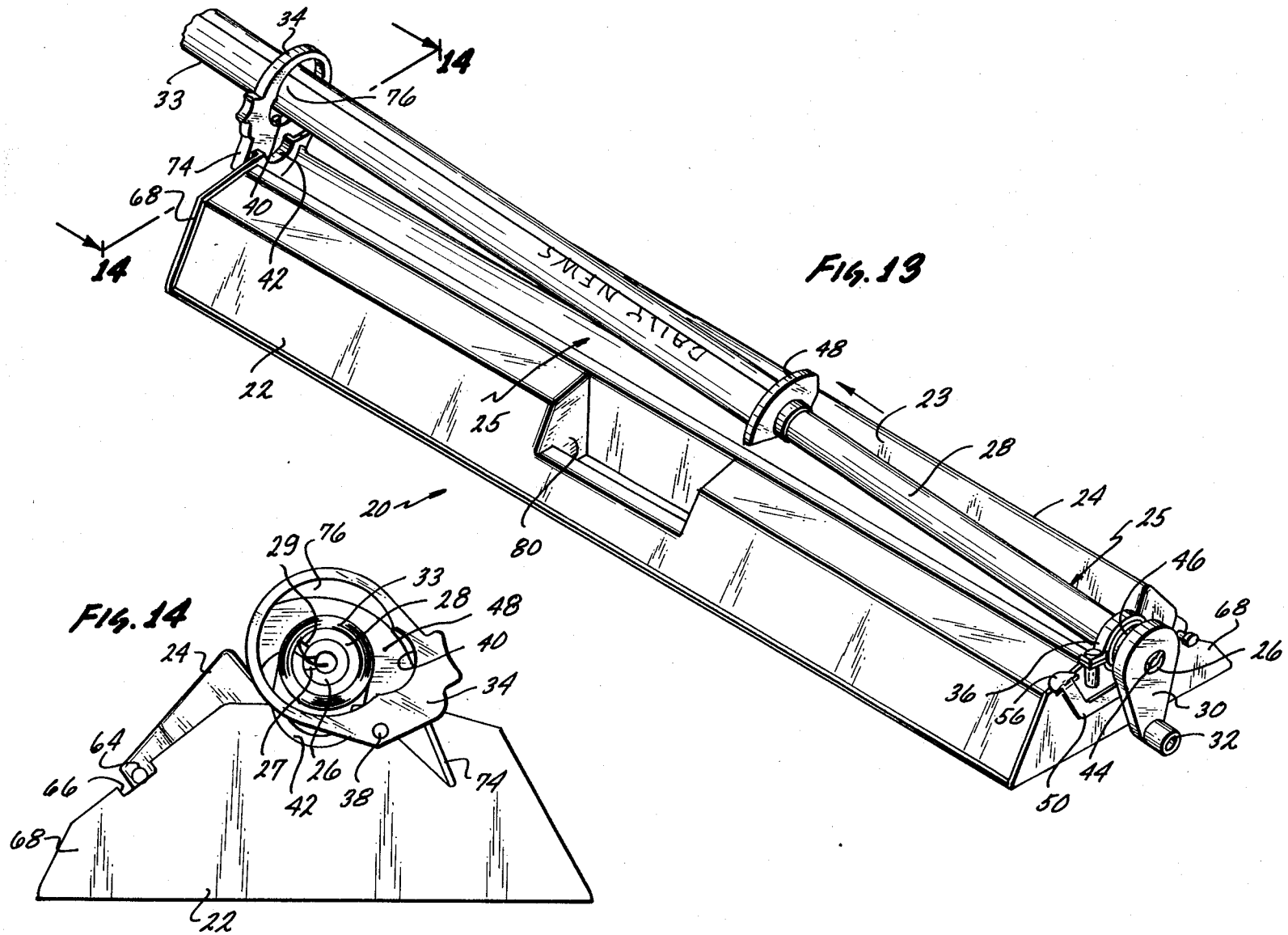
FIG. 13 is a still further perspective view of the apparatus showing the pivotable bearing member rotated to the unlocked positioned and the formed structural member being pushed off the roller by means of the pusher.
FIG. 14 is an end view looking in the direction of the arrows 14—14 of FIG. 13.

To remove the tubular structural member from the tube assembly, the handle 74 on moveable bearing 34 is grasped to rotate the bearing 34 around the pivot 38 to an open position, as shown in FIGS. 13 and 14. The portion of the tube assembly held within the bearing formed by the semicircular openings 40, 42 then falls into the enlarged opening 76. This in turn supports the formed structural member, as shown in FIG. 13.

The pusher 48 is then moved along the tube assembly to the left as shown in FIGS. 1, 2, 11, and 13. This pushes the completed structural member through the opening 76 formed in bearing 34 and off of the tube assembly. A user may then pull the formed tubular structural member completely free of the tube assembly. The bearing 34 may then be closed to allow the rolling apparatus to be in position to form another tubular structural member.

The completed structural members may be joined, as shown in FIG. 16 by means of connectors 84, 84*a*, 84*b*, as shown in FIG. 15, 15*a*, 15*b*, to build any desired shapes, such as play structures, houses, caves, domes, vehicles, animals, geodesic domes and the like. The connectors 84, 84*a*, 84*b* have either five, one or two arms, as shown at 85, 85*a*, 85*b*, to which the formed structural members may be attached. In addition, the connector 84*a* includes an opening 86 which fits over and may be held on any of the arms 85, 85*a* or 85*b* of other connectors, at any desired angle, to form further modified play structures. Still further structures may be formed using connectors 85*b*, which include an opening 87 having knotches or ribs 88 which allow such connectors to be slid over any arm 85, 85*a*, 85*b* of a further connector and held at a preselected angle thereon.

Thus, although there has been shown and described a preferred embodiment of the invention, other embodiments and configurations will be obvious to those skilled in the art without departing from the spirit and scope of the invention as defined by the attached claims.

What is claimed is:

1. Apparatus adapted to form tubular structural members by rolling flexible sheets of material;

said apparatus comprising a base; first and second bearing members held within said base;

a tube assembly having two ends rotatably supported at its ends in said bearing members, and including a pair of elongated, hollow inner and outer tubes having slots formed therein and means limiting the relative rotation of said inner and outer tubes;

a crank connected to one of said elongated hollow tubes for rotation of said tube assembly;

ratchet means connected to said other of said elongated hollow tubes for rotation therewith;

a pusher element slidably mounted on said elongated hollow outer tube;

a ratchet spring pivotedly mounted on said base and including stop means coacting with a slot formed in said ratchet means for limiting rotation of said crank in one direction while allowing said crank to be freely rotatable in the outer direction;

a tension bar pivotably mounted on said base and coacting therewith so as to provide pressure against flexible material passing over said base and being wound around said outer tube upon turning of said crank in said other direction; and said bearing member holding the end of said outer tube distant from said crank being moveably mounted on said base whereby said bearing member may be moved to align an enlarged opening formed therein with a tubular structural member formed on said tube assembly to enable said formed tubular structural member to be removed therefrom by action of said pusher sliding along the length of said outer tube from a position adjacent to said crank toward said opening in said pivotable bearing member.

2. The apparatus of claim 1 wherein said slot in said ratchet means coacts with said stop means to allow said ratchet means to be turned approximately 20 degrees when said crank handle is turned in the counter-clockwise direction whereby said slots in said tubes are aligned; and said ratchet spring and stop means allow said ratchet means to be freely turned by said crank when turning in a clockwise direction to first allow said slots in said tubes to clamp the leading edge of said flexible material held therein and to then roll said flexible material around said tube assembly to form said tubular structural member.

3. The apparatus of claim 2 wherein said moveable bearing means includes a semi-circular portion which coacts with a corresponding semi-circular portion formed integrally with said base when said moveable bearing means is in the closed position, to rotatably support said tube assembly within said moveable bearing means.

4. The apparatus of claim 3 wherein said crank is fixedly connected to said inner elongated hollow tube whereby, upon rotation of said crank, said inner elongated hollow tube will be rotated therewith, and wherein said ratchet means is fixedly connected to said outer elongated hollow tube for rotation therewith.

5. The apparatus of claim 1 in which said crank is fixedly connected to said inner elongated hollow tube for rotation of said inner elongated hollow tube therewith, and said ratchet means is fixedly connected to said outer elongated hollow tube.

6. Apparatus to form tubular structural members from flexible material, comprising in combination:

a base;

first and second bearing members held within said base;

a tube assembly having two ends rotatably supported at its ends in said bearing members, and including a pair of elongated, hollow inner and outer tubes having slots formed therein and means limiting the relative rotation of said inner and outer tubes;

a crank connected to said elongated, hollow inner tube for rotation of said elongated, hollow inner tube, and said tube assembly;

a ratchet connected to said elongated, hollow outer tube for rotation therewith;

a pusher element slidably mounted on said elongated, hollow outer tube;

a ratchet spring means pivotedly mounted on said base and cooperating with said ratchet for limiting rotation of said tube assembly in one direction while allowing said tube assembly to be freely rotatable in the other direction; and a tension means mounted on said base to coact with said flexible material as it is passing over said base and being wound around said outer tube.

* * * * *